US008951361B2

(12) United States Patent
Sutton

(10) Patent No.: US 8,951,361 B2
(45) Date of Patent: Feb. 10, 2015

(54) APPARATUS FOR GUIDING A HYDRAULIC HOSE

(76) Inventor: Daniel Sutton, Midlothian, TX (US)

( * ) Notice: Subject to any disclaimer, the term of this patent is extended or adjusted under 35 U.S.C. 154(b) by 713 days.

(21) Appl. No.: 13/314,581

(22) Filed: Dec. 8, 2011

(65) Prior Publication Data

US 2013/0145571 A1 Jun. 13, 2013

(51) Int. Cl.
*B08B 9/00* (2006.01)

(52) U.S. Cl.
USPC ..... 134/166 C; 134/166 R; 134/172; 134/164; 134/153; 15/104.31; 15/257.01; 15/268; 269/254 R; 269/34

(58) Field of Classification Search
CPC ..... B08B 9/00; B08B 13/00; B08B 9/045; E21B 2034/005; E21B 23/00
USPC ..... 134/166 C, 166 R, 164, 172; 15/104.31, 15/257.01, 268; 269/254 R, 34
See application file for complete search history.

(56) References Cited

U.S. PATENT DOCUMENTS 4,705,331 A * 11/1987 Britton ..... 439/387

* cited by examiner

*Primary Examiner* — Michael Barr
*Assistant Examiner* — Thomas Bucci
(74) *Attorney, Agent, or Firm* — Braxton, Hilton & Perrone, PLLC

(57) ABSTRACT

An apparatus for guiding hydraulic hoses for use in cleaning sewer lines. The claimed hose guide locks the hydraulic hose, near the head of the hose, in a clamp, providing rigidity for an operator trying to locate the opening of a clogged pipeline. Once the hose has been placed at the pipeline opening, the operator releases the hose from the hose guide, pressurizes the hose so as to separate the hose from the hose guide, removes the hose guide from the sewer line, and cleans the pipeline with the hydraulic hose.

19 Claims, 5 Drawing Sheets

APPARATUS FOR GUIDING A HYDRAULIC HOSE

BACKGROUND OF THE INVENTION

1. Technical Field

The present invention relates to an apparatus to guide hydraulic hoses to the proper position in a sewer line that is blocked or needs cleaning.

2. Description of Related Art

In the early 1900s steel rods were used to clean out blockages in sewer lines. This process, referred to as rodding, involved threading steel rods together in order to make a long steel rod that could be maneuvered through a sewer line. In the mid- to late-1900s, the hydraulic method was introduced. The Hydraulic method, which is used today, involves attaching a nozzle with holes in the head to a hose and navigating the hose head to the opening of the clogged pipeline from a manhole or junction box. Pressurized water is introduced into the hose and then passes through the holes in the nozzle head, propelling the hose down the pipeline to remove the blockage. The Hydraulic method allows operators to clean more pipeline quicker and easier than the rodding process; however, there is no rigidity to the hose and thus, operators cannot direct the leading end of the hose into the correct pipeline easily. Due to the fact that the hose is limber, operators have little control over where the head is guided in the sewer line. Additionally, the design of manholes or junction boxes makes it difficult for operators to see the opening for pipelines. The blockage can also cause sewer water to back up and further obscure the pipeline opening. Because of these factors, the hose and head can coil at the bottom of a manhole or junction box and be deflected back out of the manhole or junction box when the hose is pressurized, putting the operator and equipment at risk.

Therefore, there exists a need for an apparatus to guide the hydraulic hose into the proper position within the blocked sewer line. The guide should provide rigidity to the hose head and enable the operator to feel for the opening of the clogged pipeline.

SUMMARY OF THE INVENTION

The present invention is directed to an apparatus for guiding hydraulic hoses for use in cleaning sewer lines. The claimed hose guide locks the hydraulic hose, near the head of the hose, in a clamp, providing rigidity for an operator trying to locate the opening of a clogged pipeline. Once the hose has been placed at the pipeline opening, the operator releases the hose from the hose guide, pressurizes the hose so as to separate the hose from the hose guide, removes the hose guide from the sewer line, and cleans the pipeline with the hydraulic hose.

The claimed hose guide is comprised of a pipe, with a first and second end, fitted with a hose clamp. The hose clamp is two complementary arcuate members welded to the wings of a hinge rotably mounted on a shaft that runs through the center of the pipe. The shaft is supported within the pipe by a first and fourth bushing secured to the pipe. Second and third bushings, secured to the shaft, abut the hinge and act as a stop to prevent the hinge from moving on the shaft. The third bushing also acts as a stop for and provides tension on a compression spring that is rotably mounted on the shaft between the third and fourth bushings. A torsion spring rotably mounted on the shaft in a cut-out portion in the middle of the hinge provides the force to open the hose clamp. The compression spring provides the force to close the hose clamp and keep it in the locked position.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Several embodiments of Applicants' invention will now be described with reference to the drawings. Unless otherwise noted, like elements will be identified by identical numbers throughout all figures. The invention illustratively disclosed herein suitably may be practiced in the absence of any element which is not specifically disclosed herein.

The present invention is directed to an apparatus for guiding hydraulic hoses for use in cleaning sewer lines. The claimed hose guide locks the hydraulic hose, near the head of the hose, in a clamp and then releases the hose when it has been placed in the proper position. The claimed hose guide provides rigidity to the hose, allowing an operator to more easily navigate the hose head to the pipeline opening, resulting in a quicker, safer method for cleaning blocked sewer lines.

Figure 1:
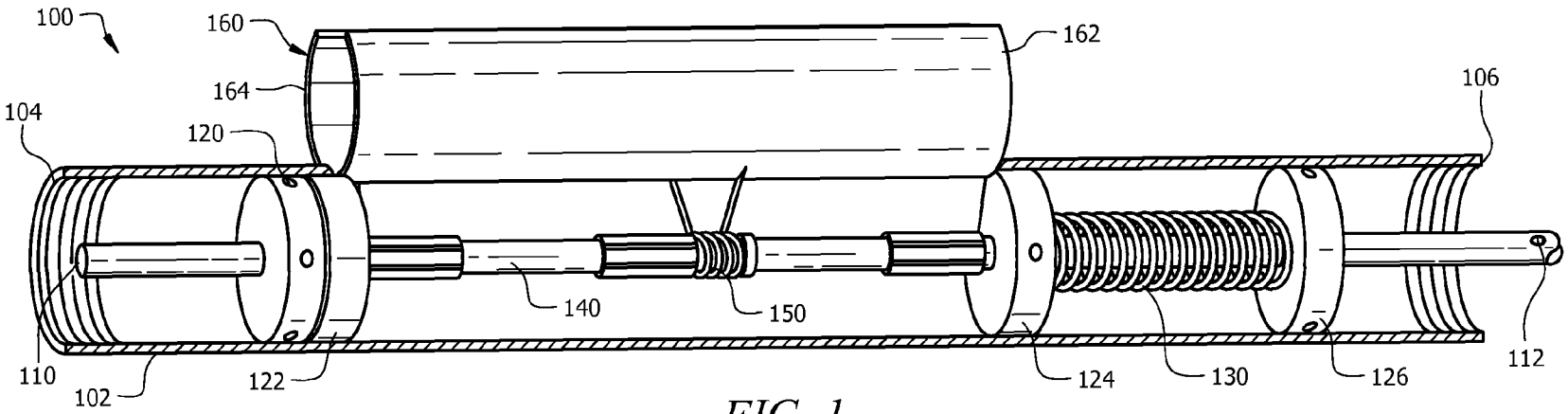
FIG. 1 is a schematic side elevational view of one embodiment of the claimed invention.

Referring to FIG. 1, the hose guide 100 is comprised of a pipe 102 fitted with a hose clamp 160 for holding a hydraulic hose. The pipe has a first end 104 and second end 106. In one embodiment, the pipe 102 is about 12 inches long and about 1 inch in diameter. Preferably, the pipe 102 is stainless steel but may be of another corrosion-resistant material known in the art, such as black iron or heavy wall PVC, so long as the strength and durability of the material meets the requirements necessary to accomplish the purpose of the invention. In one embodiment, the pipe 102 is threaded on both ends with standard national pipe threads to allow coupling with other components, such as more lengths of pipe at second end 106 or a head at first end 104.

Figure 2:
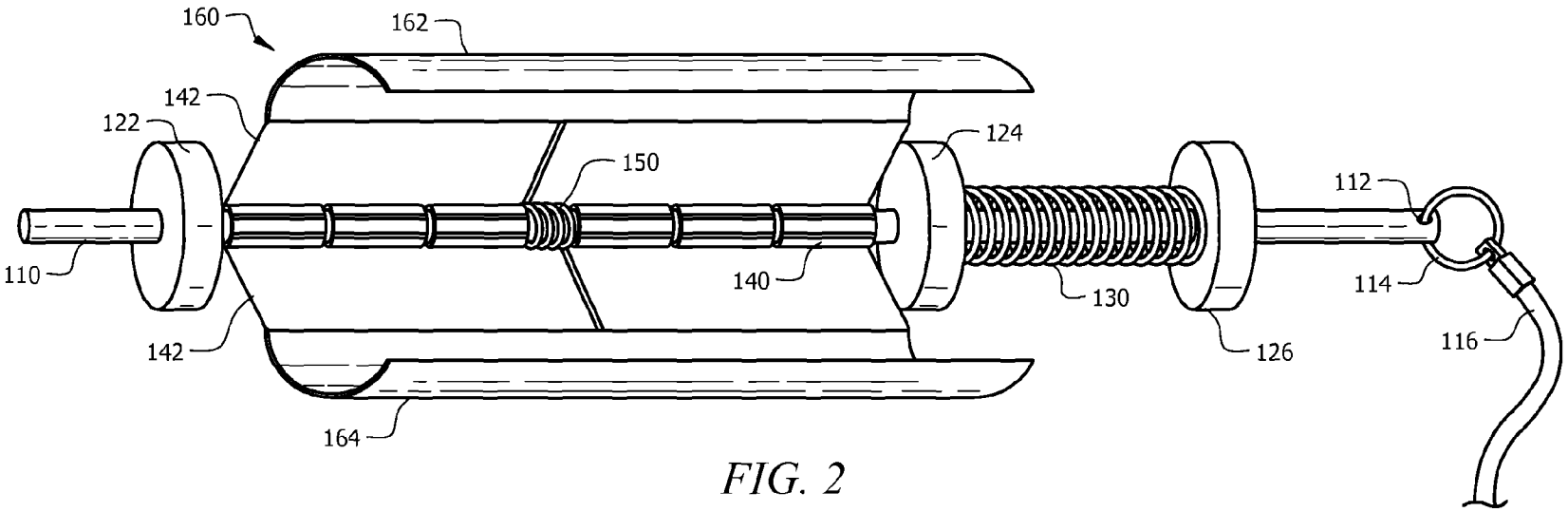
FIG. 2 is a partial side elevational view of one embodiment of the claimed invention.

A cylindrical shaft 110 of substantially the same length as the pipe 102 runs through the center of the pipe 102. The shaft can have a diameter of about 3/16 inches to about 5/16 inches and should be a corrosion-resistant material. In one embodiment, the shaft 110 is an about ¼ inch stainless steel shaft. The shaft 110 may have a hole 112 drilled through it at the end of the shaft adjacent to the second end 106 of the pipe 102. As shown in FIG. 2, a split ring 114 and stainless steel cable 116, preferably with a swadge eye used to couple the stainless steel cable 116 to the split ring 114, may be attached to the shaft 110 through the hole 112 to allow a practitioner to move the shaft 110 longitudinally within the pipe 102.

Referring again to FIG. 1, the shaft 110 is supported within the pipe 102 by two bushings, a first bushing 120 and a fourth bushing 126. As used herein, a bushing is a disc-shaped object, similar to a washer, with a length of about ⅜ inches to about ¾ inches. In one embodiment, the outside diameter of the first and fourth bushings 120, 126 is substantially equal to the inner diameter of the pipe 102 and the inner diameter of the first and fourth bushings 120, 126 is substantially equal to the outer diameter of the shaft 110. The first and fourth bushings 120, 126 have a fixed position within the pipe 102 and are secured to the pipe 102 by set screws or any other means known in the art. The first bushing 120 is set approximately ⅜ inches towards the first end 104 of the pipe 102 from a slot 109 in the top of pipe 102 (described below). The fourth bushing 126 is set in relation to the compression spring 130 as described below. In one embodiment, the first and fourth bushings 120, 126 are made of bronze as bronze is corrosion-resistant and allows the shaft 110 to rotate and move longitudinally through the bushings without freezing when foreign objects such as sand or dirt falls between the bushing and the shaft. Any other corrosion-resistant material that accomplishes this purpose could also be used.

Positioned inside, or closer to the center of the pipe 102, of the first and fourth bushings 120, 126 within the pipe 102 on the shaft 110 are the second and third bushings 122, 124. In one embodiment, the outside diameter of the second and third bushings 122, 124 is less than the inner diameter of the pipe 102 and the inner diameter of the second and third bushings 122, 124 is substantially equal to the outer diameter of the shaft 110. The outer diameter of the second and third bushings 122, 124 should be about ⅜ inches to about ¾ inches less than the inner diameter of the pipe 102 to allow debris to pass by the bushings without locking up the shaft 110. In one embodiment, the outside diameter of the second and third bushings 122, 124 is about ¼ inch less than the inner diameter of the pipe 102. The second and third bushings 122, 124 have a fixed position on the shaft 110 and mounted thereon by set screws or any other means known in the art. In one embodiment, the second and third bushings 122, 124 are made of aluminum but they may be made of any corrosion-resistant material, such as plastic or nylon.

A compression spring 130 is rotably mounted the shaft 110 between the third and fourth bushings 124, 126. The third and fourth bushings 124, 126 are set in position that keep the compression spring 130 at tension but not fully compressed. The compression spring 130 is set such that when the hose clamp 160 is in the locked position, the compression spring 130 is not allowed to fully extend itself and is still slightly compressed. It is the compression spring 130 that applies the force to keep the hose clamp 160 in the locked position, as explained below. The compression spring 130 abuts the third and fourth bushings 124, 126 such that when the shaft 110 is moved longitudinally toward the second end 106 of the pipe 102, thereby moving the third bushing 124 toward the fourth bushing 126, the compression spring 130 is compressed. The compression spring 130 is preferably at least 15 inch-pounds of strength.

A hinge 140 is rotably mounted on the shaft 110 between the second and third bushings 122, 124 such that the second and third bushings 122, 124 abut the ends of the hinge 140. The hinge 140 may be a typical door hinge, with the barrel of the hinge rotably mounted on the shaft 110, such that the shaft 110 acts as the pin, and wings 142. A portion of the barrel of the hinge 140 is cut out to accommodate a torsion spring 150. As best shown in FIG. 2, the torsion spring 150 is rotably mounted on the shaft 110 in the middle of the hinge 140 within the cut-out portion of the barrel, such that the ends of the torsion spring 150 extend between the hinge wings 142. The torsion spring 150 may be of any strength appropriate to open the hose clamp 160 as explained below. In one embodiment, the torsion spring 150 is preferably at least 12 torque-pounds of strength.

Figure 5:
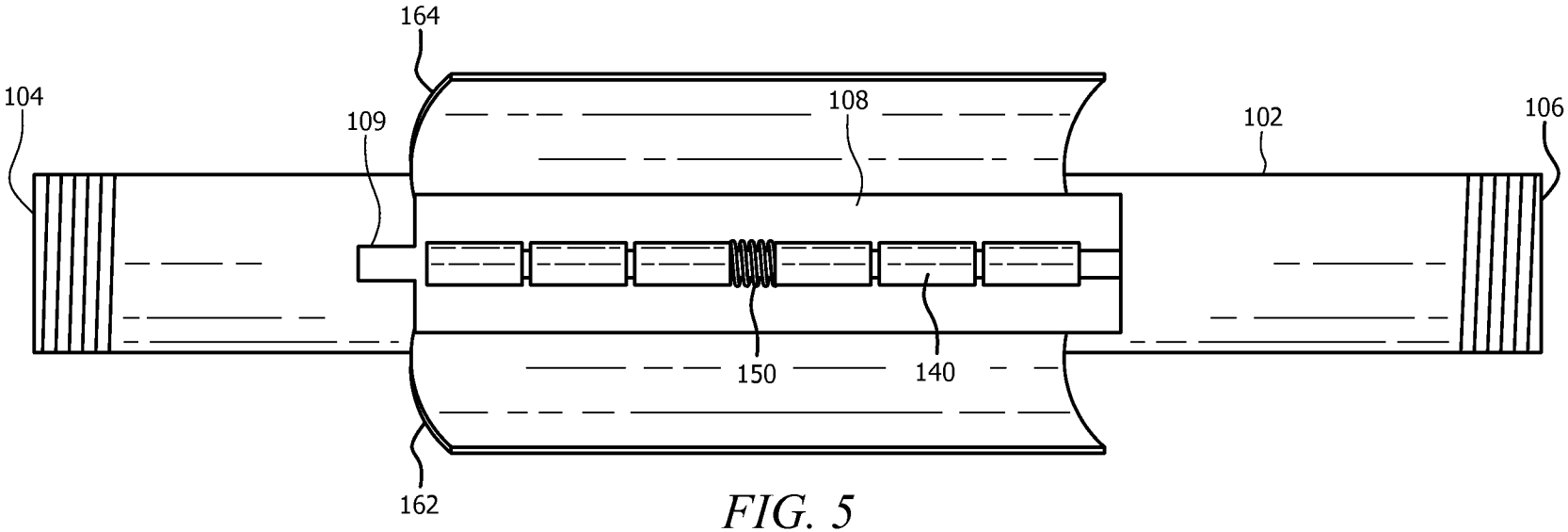
FIG. 5 is a top elevational view of one embodiment of the claimed invention with the hose clamp is in the open position.

The hose clamp 160 is made up of two complementary arcuate members 162, 164 welded to the hinge wings 142. When viewed from one end of the pipe 102, as seen in FIG. 5, looking down the pipe 102 to the opposing end, the complementary arcuate members 162, 164 form a horseshoe shape. The complementary arcuate members 162, 164 are pieces of pipe, preferably stainless steel pipe, cut in a manner such that the inside diameter of the complementary arcuate members 162, 164 in its closed position is substantially equal to the outside diameter of a hydraulic hose. The complementary arcuate members 162, 164 can be constructed of any corrosion-resistant material. However, the complementary arcuate members 162, 164 are not adjustable, so a practitioner must construct a hose guide 100 for each size of hydraulic hose to be used.

Figure 3:
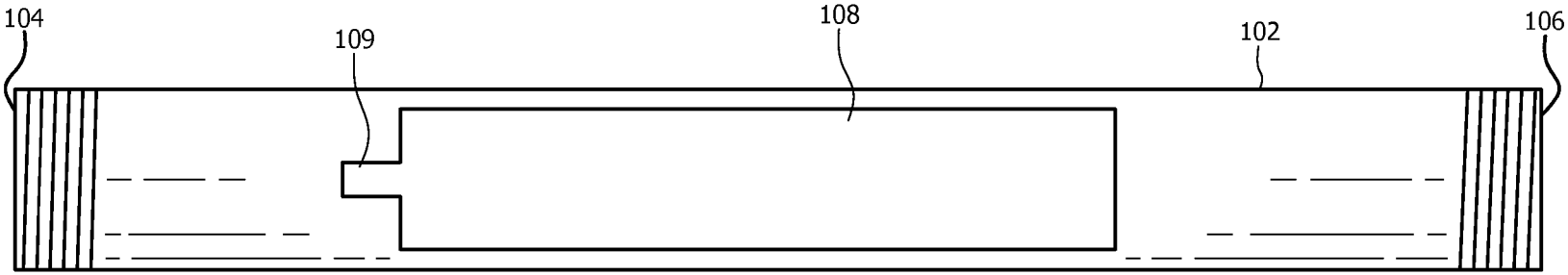
FIG. 3 is a partial top elevational view of one embodiment of the claimed invention.

Referring to FIG. 3, the pipe 102 has a substantially rectangular section 108 cut out through which the hinge wings 142 extend such that the hose clamp 160 protrudes above the pipe 102. A slot 109 extends from the substantially rectangular section 108 at the side adjacent to the first end 104 of the pipe 102. In the locked or closed position, the hinge wings 142 sit within the slot 109, keeping the hose clamp 160 closed around the hydraulic hose.

Figure 4:
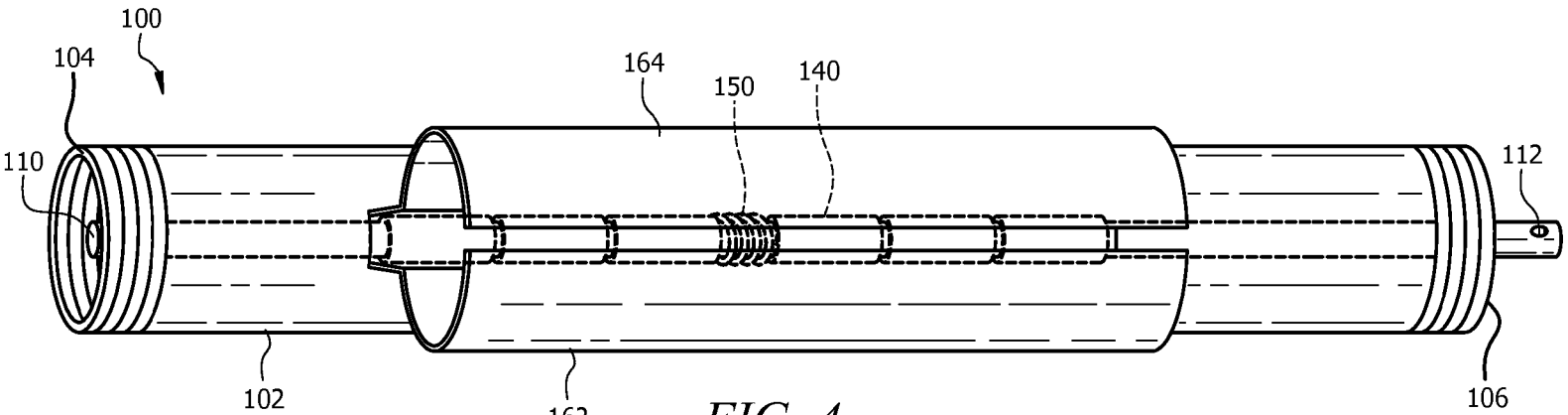
FIG. 4 is a top elevational view of one embodiment of the claimed invention with the hose clamp is in the closed position.

FIGS. 1 and 4 show the hose guide 100 in its closed position. In the closed position, the compression spring 130 provides the force necessary to keep the hose clamp 160 locked in the clamping position and the hinge wings 142 held in the slot 109. To open the hose clamp 160 so that a hydraulic hose may be received and held by the complementary arcuate members 162, 164, as shown in FIGS. 2 and 5, the shaft 110 at the second end 106 of the pipe 102 is pulled back. The split ring 114 or stainless steel cable 116 inserted into the hole 112 in the shaft 110 aids the practitioner in exerting the force necessary. As the shaft 110 is pulled longitudinally toward the second end 106 of the pipe 102, the second bushing 122 forces the hinge 140 to move towards the second end 106 of the pipe 102 and the hinge wings 142 move out of the slot 109. Once the hinge wings 142 are clear of the slot 109, the torsion spring 150 causes the hinge wings 142 to open, thereby opening the hose clamp 160. As the shaft 110 moves towards the second end 106 of the pipe 102, the third bushing 124 causes the compression spring 130 to compress. The tension in the compressed compression spring 130 holds the hinge wings 142 open as they are forced against the shoulders of the substantially rectangular section 108 near the first end 104 of the pipe 102 as shown in FIG. 5. To close the hose clamp 160 after the hydraulic hose has been placed within the open complementary arcuate members 162, 164, the complementary arcuate members 162, 164 are be manually pushed together. The energy stored by the compressed compression spring 130 causes the third bushing 124 to push the hinge 140 back toward the first end 104 of the pipe 102 and the hinge wings 142 to slide back into the slot 109.

Figure 6:
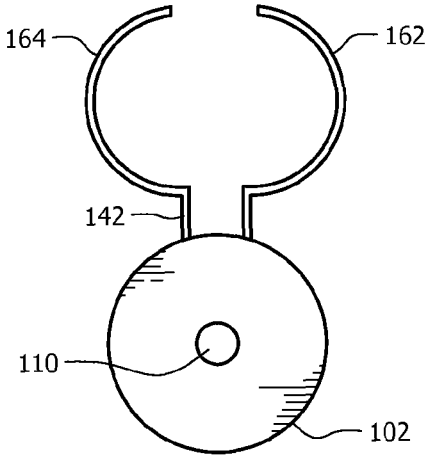
FIG. 6 is a side view of one embodiment of the claimed invention.
Figure 7A:
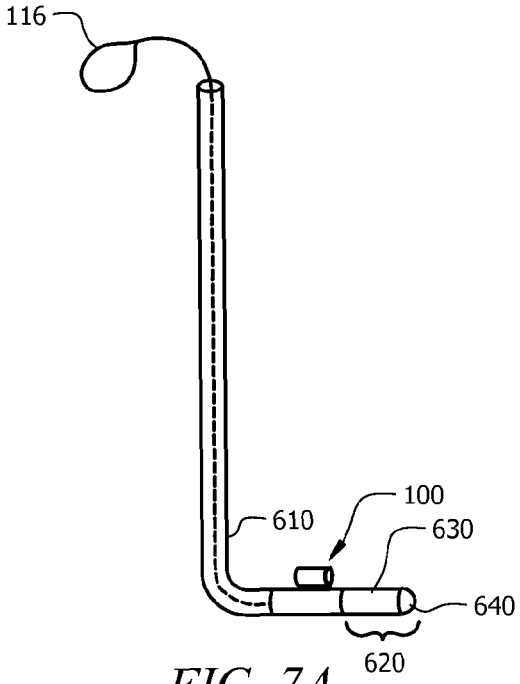
FIGS. 7A and 7B are diagrams of one embodiment of the claimed invention in use.
Figure 7B:
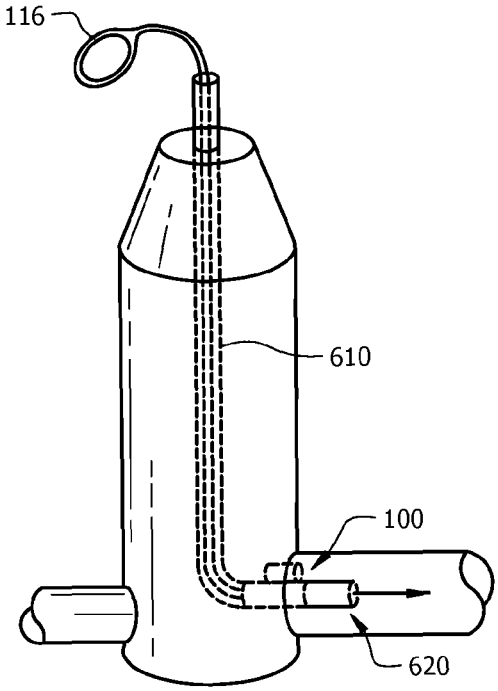

Referring to FIGS. 6A and 6B, to use the hose guide 100 to clean out sewer lines, a series of pipes 610 can be connected to the threads on the pipe 102 to lengthen the hose guide 100. At the first end 104 of the pipe 102, a head 620 can be attached to further aid a user in feeling for the proper place to position the hydraulic hose in the sewer line. In one embodiment, a 10 inch nipple 630 and cap 640 is used. At the second end 106 of the pipe 102, a pipe with a 90° bend can be attached. A series of pipe can then be attached to the L-shaped pipe to allow the hose guide 100 to be lowered to the necessary depth in the sewer line. The cable 116 is extended through the series of pipe so that an operator can pull the cable to release the hydraulic hose from the hose clamp 160. Once the hose is placed in the proper position within the sewer line, the operator can pull on the cable 116 to release the hose, pressurize the hose so as to separate the hose from the hose guide, remove the hose guide 100 from the sewer line, and clean the clogged pipeline. The claimed hose guide 100 enables users to more quickly, efficiently, and safely place hydraulic hoses in clogged pipe openings within sewer lines.

While this invention has been particularly shown and described with reference to preferred embodiments, it will be understood by those skilled in the art that various changes in form and detail may be made therein without departing from the spirit and scope of the invention. All ranges herein are intended to encompass the exact ranges as well as the approximate ranges. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. An apparatus for guiding a hydraulic hose for use in cleaning sewer lines comprising:

a pipe having a first end and a second end;

a cylindrical shaft extending through the center of said pipe, said shaft supported by a first bushing and a fourth bushing, wherein said first and fourth bushings are secured to said pipe;

a second and third bushing on said shaft positioned distal from said first and second end of said pipe, wherein said second and third bushings are secured to said shaft;

a compression spring having two ends rotably mounted on said shaft located between said third bushing and said fourth bushing, wherein said ends of said compression spring abut said third bushing and said fourth bushing;

a hinge having a barrel and two wings rotably mounted on said shaft between said second bushing and said third bushing, wherein said second bushing and said third bushing abut said barrel, and further wherein said barrel has a portion cut out of the middle;

a torsion spring having two ends rotably mounted on said shaft in said cut out portion of said barrel of said hinge, wherein said ends of said torsion spring extend between said wings of said hinge; and a hose clamp, wherein said hose clamp comprises two complementary arcuate members welded to said wings of said hinge such that said complementary arcuate members form a partial circle capable of holding a hose.

2. The apparatus of claim 1 wherein said pipe has a substantially rectangular cut-out on one side through which said wings of said hinge extend, and further wherein a slot extends from said substantially rectangular cut-out at the end of said substantially rectangular cut-out proximate to said first end of said pipe.

3. The apparatus of claim 1 wherein said pipe is about 12 inches long and has a diameter of about 1 inch.

4. The apparatus of claim 1 wherein said pipe is stainless steel, black iron, or heavy wall PVC.

5. The apparatus of claim 1 wherein said pipe has standard national pipe threads on said first end and said second end.

6. The apparatus of claim 1 wherein said shaft is substantially the same length as said pipe.

7. The apparatus of claim 1 wherein said shaft is stainless steel and has a diameter of about 3/16 inches to about 5/16 inches.

8. The apparatus of claim 7 wherein said shaft has a diameter of about ¼ inch.

9. The apparatus of claim 1 wherein said shaft has a hole drilled through it near its end proximate to said second end of said pipe.

10. The apparatus of claim 1 wherein the outer diameter of said first and fourth bushings is substantially equal to the inner diameter of said pipe and the inner diameter of said first and fourth bushings is substantially equal to the outer diameter of said shaft.

11. The apparatus of claim 1 wherein said first and fourth bushings comprise bronze.

12. The apparatus of claim 1 wherein the outer diameter of said second and third bushings is about ⅜ inches to about ¾ inches less than the inner diameter of said pipe and the inner diameter of said second and third bushings is substantially equal to the outer diameter of said shaft.

13. The apparatus of claim 1 wherein the outer diameter of said second and third bushings is about ¼ inch less than the inner diameter of said pipe and the inner diameter of said second and third bushings is substantially equal to the outer diameter of said shaft.

14. The apparatus of claim 1 wherein said second and third bushings comprise aluminum.

15. The apparatus of claim 1 wherein said first and fourth bushings are secured to said pipe by set screws and said second and third bushings are secured to said shaft by set screws.

16. The apparatus of claim 1 wherein said compression spring is at least 15 inch-pounds of strength.

17. The apparatus of claim 1 wherein said torsion spring is at least 12 torque-pounds of strength.

18. The apparatus of claim 1 wherein said complementary arcuate members are stainless steel.

19. The apparatus of claim 9 further comprising a split ring or stainless steel cable attached to said shaft through said hole.

* * * * *